US007824461B2

(12) United States Patent
Chan et al.

(10) Patent No.: US 7,824,461 B2
(45) **Date of Patent: *Nov. 2, 2010**

(54) METHOD AND APPARATUS FOR MAKING MAGNESIUM-BASED ALLOY

(75) Inventors: Kam-Shau Chan, Taipei Hsien (TW); Cheng-Shi Chen, Taipei Hsien (TW); Li-Qing Zhang, Taiyuan (CN); Wen-Zhen Li, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 173 days.

This patent is subject to a terminal disclaimer.

(21) Appl. No.: 12/200,324

(22) Filed: Aug. 28, 2008

(65) Prior Publication Data

US 2009/0056499 A1 Mar. 5, 2009

(30) Foreign Application Priority Data

Aug. 31, 2007 (CN) ..... 2007 1 0076771

(51) Int. Cl.
*C22B 26/22* (2006.01)
*C22B 4/02* (2006.01)

(52) U.S. Cl. ..... 75/10.13; 164/47; 420/590

(58) Field of Classification Search ..... 75/10.13; 420/590; 164/47

See application file for complete search history.

(56) References Cited

U.S. PATENT DOCUMENTS

2009/0057957 A1* 3/2009 Chan et al. ..... 264/328.2
2009/0127743 A1* 5/2009 Chan et al. ..... 264/294

FOREIGN PATENT DOCUMENTS

CN 1772414 A 5/2006

OTHER PUBLICATIONS

"Magnesium (Mg)". Prokon Version 8.6 Copyright 1997-98 by Harold Schwartz for ShowMe Software.*

Machine translation of CN 1772414 (claims), patent published May 17, 2006.*

Fabrication and Mechanical Properties of Carbon Nanotube/ZM5 Composites, QI Dao-Hua et al., Foundry Technology, vol. 28 No. 5, p. 676-682, May 2007, China.

Fabrication and Properties of Particulate Reinforced Magnesium Matrix composites, Master thesis, Xian University of Technology, Hongqiang Nan,Jun. 1, 2007,China.

Powder Injection Moulding Techology for NdFeB Magnets, China Die & Mouldindustry, Xie Jian,Jun. 30, 2005, China.

Development of novel carbon nanotube reinforced magnesium nanocomposites using the powder metallurgy technique, CS Goh et al., Nanotechnology, vol. 17, p. 7-12 (2006).

* cited by examiner

*Primary Examiner*—George Wyszomierski
*Assistant Examiner*—Tima M McGuthry-Banks
(74) *Attorney, Agent, or Firm*—D. Austin Bonderer

(57) ABSTRACT

A method for fabricating a magnesium-based alloy includes the steps of: (a) mixing a number of carbon nanotubes with a number of magnesium particles; (b) heating the mixture in a protective gas to achieve a semi-solid-state paste; (c) stirring the semi-solid-paste using an electromagnetic stirring force to disperse the carbon nanotubes into the paste; (d) injecting the semi-solid-state paste into a die; and (e) cooling the semi-solid-state paste to achieve a magnesium-based alloy. An apparatus for fabricating the magnesium-based alloy includes a transferring device, a thixomolding machine, and an electromagnetic stirring device. The transferring device includes a feed inlet. The thixomolding machine includes a heating barrel having two ends, a nozzle disposed at a first end thereof, and an material input positioned at a second end thereof. The electromagnetic stirring device includes an electromagnetic induction coil disposed on an outer wall of the heating barrel.

15 Claims, 2 Drawing Sheets

METHOD AND APPARATUS FOR MAKING MAGNESIUM-BASED ALLOY

BACKGROUND

1. Field of the Invention

The present invention relates to methods and apparatuses for fabricating alloys and, particularly, to a method and an apparatus for fabricating a magnesium-based alloy.

2. Discussion of Related Art

Nowadays, alloys have been developed for special applications. Among these alloys, the magnesium alloy has some good properties, such as good wear resistance, and high elastic modulus. However, the toughness and the strength of the magnesium alloy are not able to meet the increasing needs of the automotive and aerospace industries.

To address the above-described problems, magnesium-based alloys have been developed. In a magnesium-based alloy, nanoscale reinforcements (e.g. carbon nanotubes and carbon nanofibers) are added to the magnesium metal or alloy. The conventional methods for making the magnesium-based alloy are by thixo-molding and die-casting. However, in die-casting, the magnesium metal or magnesium alloy tend to be easily oxidized. In thixo-molding, the nanoscale reinforcements are added to melted metal or alloy, causing the nanoscale reinforcements to have tendency to aggregate. Therefore, the nanoscale reinforcements can't be uniformly dispersed therein.

What is needed, therefore, is to provide a method and an apparatus for fabricating a magnesium-based alloy, in which nanoscale reinforcements can be uniformly dispersed in the magnesium-based alloy, and the magnesium-based alloy has good toughness and high strength.

SUMMARY

A method for fabricating a magnesium-based alloy includes: mixing a number of carbon nanotubes with a number of magnesium particles; heating the mixture in a protective gas to achieve a semi-solid-state paste; stirring the semi-solid-state paste using an electromagnetic stirring force to disperse the carbon nanotubes into the paste; injecting the semi-solid-state paste into a die; and cooling the semi-solid-state paste to achieve a magnesium-based alloy. An apparatus for fabricating magnesium based alloy is also described.

Other advantages and novel features of the present method and apparatus for fabricating the magnesium-based alloy will become more apparent from the following detailed description of preferred embodiments when taken in conjunction with the accompanying drawings.

BRIEF DESCRIPTION OF THE DRAWINGS

Many aspects of the present method for fabricating a magnesium-based alloy can be better understood with reference to the following drawings. The components in the drawings are not necessarily to scale, the emphasis instead being placed upon clearly illustrating the principles of the present method for fabricating magnesium-based alloy.

Figure 1:
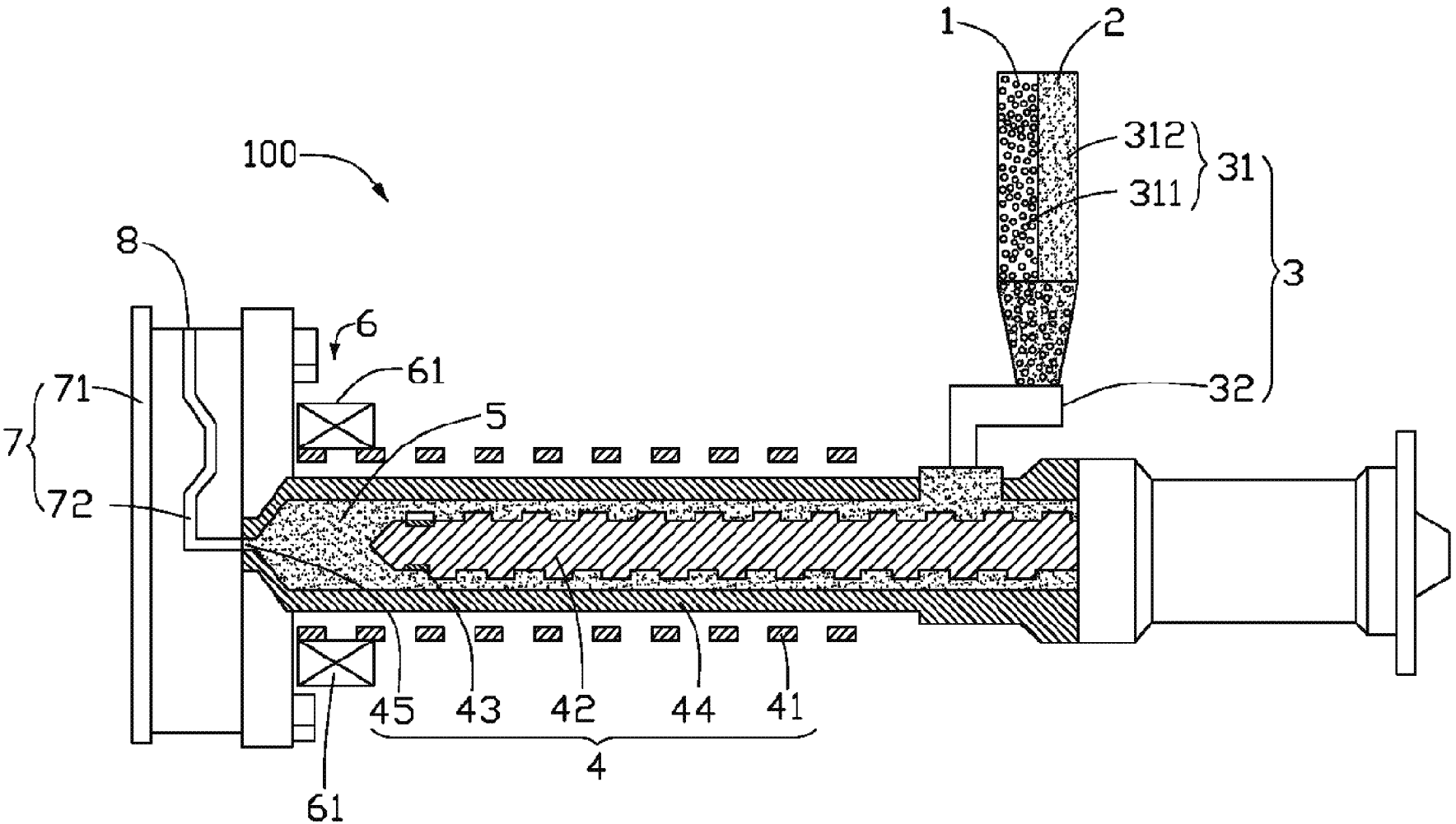
FIG. 1 is a schematic cross-view of an apparatus for fabricating a magnesium-based alloy, in accordance with an exemplary embodiment.

Corresponding reference characters indicate corresponding parts throughout the several views. The exemplifications set out herein illustrate at least one embodiment of the present method for fabricating the magnesium-based alloy, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the method and the apparatus for fabricating the magnesium-based alloy.

Referring to FIG. 1, an apparatus 100 for fabricating a magnesium-based alloy 8 includes a transferring device 3, a thixomolding machine 4, an electromagnetic stirring device 6, and an injection molding machine 7 arranged in alignment in that order. The transferring device 3 includes a feed inlet 31 with a conveyer portion 32 (i.e., a material input device) connected thereto. The feed inlet 31 includes a first feed inlet 311 and a second feed inlet 312 connected to the first feed inlet 311. The thixomolding machine 4 includes a heating barrel 44 and a nozzle 45. The heating barrel 44 has two ends opposite to each other. The nozzle 45 is disposed at a first end thereof. The conveyer portion 32 is positioned at a second end thereof. Further, the thixomolding machine 4 can also include a heating portion 41 disposed around an outer wall of the heating barrel 44, a plunger 42 (i.e., stirrer) disposed in a center of the heating barrel 44, and a one-way valve 43 positioned on the plunger 42. The one-way valve 43 enable the material in the heating barrel 44 moving along one direction. The electromagnetic stirring device 6 includes an electromagnetic induction coil 61 and a power source (not shown). The electromagnetic induction coil 61 is disposed on the outer wall of the first end of the heating barrel 44. The injection molding machine 7 includes a die 71 connected to the nozzle 45.

Figure 2:
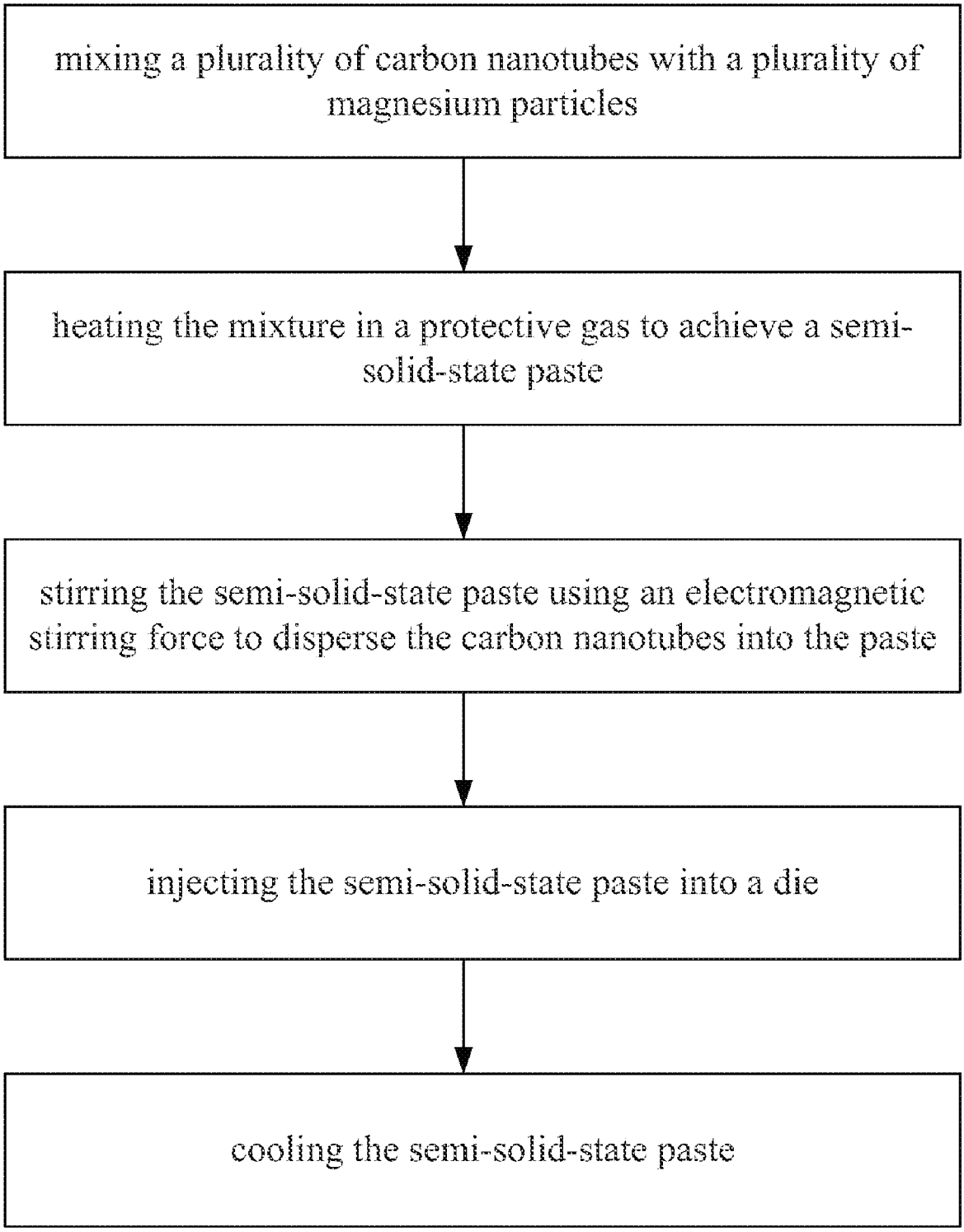
FIG. 2. is a flow chart of a method for fabricating a magnesium-based alloy, in accordance with an exemplary embodiment.

Referring to FIG. 2, a method for fabricating the magnesium-based alloy 8 includes the steps of: (a) mixing a number of carbon nanotubes 2 with a number of magnesium particles 1; (b) heating the mixture in a protective gas to achieve a semi-solid-state paste 5; (c) stirring the semi-solid-state paste 5 using an electromagnetic stirring force to disperse the carbon nanotubes 2 into the paste 5; (d) injecting the semi-solid-state paste 5 into a die 71; and (e) cooling the semi-solid-state paste 5 to achieve a magnesium-based alloy 8.

In step (a), The magnesium particles 1 are made of magnesium metal or magnesium alloy. The magnesium alloy includes magnesium and other elements selected from a group comprising of zinc (Zn), manganese (Mn), aluminum (Al), thorium (Th), lithium (Li), silver, calcium (Ca), and any combination thereof. A mass ratio of the magnesium metal to the other elements can be more than 4:1.

The carbon nanotubes 2 can be selected from a group comprising of single-wall carbon nanotubes, double-wall carbon nanotubes, multi-wall carbon nanotubes, and combinations thereof. A diameter of the carbon nanotubes 2 can be in the approximate range from 1 to 150 nanometers. A length of the carbon nanotubes 2 can be in the approximate range from 1 to 10 microns, the diameter thereof is about 20-30 nanometers, and the length thereof is about 3-4 microns. A mass ratio of the carbon nanotubes 2 to the magnesium particles 1 can be in the approximate range from 1:50 to 1:200.

In the present embodiment, a number of carbon nanotubes 2 and a number of magnesium particles 1 are provided via the first feed inlet 311 and the second feed inlet 312 respectively, which enter the conveyer portion 32, forming a mixture of the magnesium particles 1 and the carbon nanotubes 2. The magnesium particles 1 are pure magnesium metal. The carbon nanotubes 2 are single-wall carbon nanotubes. The mass ratio of the carbon nanotubes 2 to the magnesium particles 1 is about 1:100.

In step (b), the mixture of the carbon nanotubes 2 and the magnesium particles 1 is heated in the heating barrel 44. The heating barrel 44 is kept at a pre-determined temperature. The pre-determined temperature can be in the approximate range from 550° C. to 750° C. The heating barrel 44 is filled with a protective gas. The protective gas can be nitrogen ($N_2$) or a noble gas. The plunger 42 mixes the carbon nanotubes 2 with the magnesium particles 1, achieving an initial dispersion of the carbon nanotubes 2 into the semi-solid-state paste 5.

In the present embodiment, the mixture is heated in the heating portion 41 disposed around the outer wall of the heating barrel 44 to a semi-solid-state paste 5. The heating temperature is at about 700° C. The semi-solid-state paste 5 can be disposed in the heating barrel 41 and driven to the electromagnetic stirring device 6 by the plunger 42. The one-way valve 43 enable the semi-solid-state paste 5 moving along one direction. Further, the heating barrel 41 is full of a protective gas therein. In this embodiment, the protective gas is argon ($Ar_2$).

In step (c), the electromagnetic stirring force is imparted by an electromagnetic stirring device 6. Power of the electromagnetic stirring device 6 can be in the approximate range from 0.2 to 15 kilowatts. A frequency of the electromagnetic stirring device 6 can be in the approximate range from 5 to 30 hertz. A speed of the electromagnetic stirring device 6 can be in the approximate range from 500 rpm to 3000 rpm.

In detail, an alternating magnetic field (either single phase or multiphase) is applied through a conductor (not shown), to the semi-solid-state paste 5, and hence a Lorentz force distribution is achieved. This Lorentz force can be generally rotational, and the semi-solid-state paste 5 is set in motion. Thus the magnetic field acts as a nonintrusive stirring device and it can, in principle, be engineered to provide any desired pattern of stirring. Stirring may also be adjusted by the interaction of a steady current distribution driven through the associated magnetic field. When the field frequency is high, the Lorentz force is confined to a thin electromagnetic boundary layer, and the net effect of the magnetic field is to induce either a tangential velocity or a tangential stress just inside the boundary layer. The intensity of the electromagnetic stirring force is adjusted by a power of the electromagnetic stirring device 6. The speed of the electromagnetic stirring force is adjusted by a frequency of the electromagnetic stirring device 6. Stirring the semi-solid-state paste 5 by the electromagnetic stirring force, and thereby uniformly dispersing the carbon nanotubes 2 into the paste 5, and achieving the dispersion and saturation of the carbon nanotubes 2 into the paste 5.

In the present embodiment, the semi-solid-state paste 5 is electromagneticly stirred to disperse the carbon nanotubes 2 in the semi-solid-state paste 5. Dispersion and saturation of the carbon nanotubes 2 therein is achieved. In the electromagnetic stirring step, the semi-solid-state paste 5 is stirred by using electromagnetic force, avoiding flotage of the carbon nanotubes 2 on the semi-solid-state paste 5. Accordingly, the carbon nanotubes 2 can be distributed throughout the semi-solid-state paste 5. As such, the dispersion uniformity of the carbon nanotubes 2 in the magnesium-based alloy 8 can, thus, be improved.

In step (d), the semi-solid-state paste 5 can, advantageously, be injected into a die 71. After being cooled, the semi-solid-state paste 5 is cured to form the solid magnesium-based alloy 8. Then, the magnesium-based alloy 8 can be removed from the molds.

In the present embodiment, in step (d), at an elevated temperature, the semi-solid-state paste 5 is driven to the nozzle 45 by the electromagnetic stirring force, and can be injected into a cavum 72, of the die 71 to form a magnesium-based alloy 8. The shape of the magnesium-based alloy 8 is determined by the shape of the die 71. The achieved magnesium-based alloy 8 is strong, tough, and has a high density, and can be widely used in a variety of fields such as the automotive and aerospace industries.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that above description and the claims drawn to a method may include some indication in reference to certain steps. However, the indication used is only to be viewed for identification purposes and not as a suggestion as to an order for the steps.

What is claimed is:

1. A method for fabricating a magnesium-based alloy, the method comprising the steps of:

mixing a plurality of carbon nanotubes with a plurality of magnesium particles to achieve a mixture;

heating the mixture in a protective gas to achieve a semi-solid-state paste;

stirring the semi-solid-state paste using an electromagnetic stirring force to disperse the plurality of carbon nanotubes into the semi-solid-state paste;

injecting the semi-solid-state paste into a die; and cooling the semi-solid-state paste.

2. The method as claimed in claim 1, wherein a material of the plurality of magnesium particles is selected from the group consisting of pure magnesium and magnesium alloy.

3. The method as claimed in claim 2, wherein the magnesium alloy comprises magnesium and an element selected from the group consisting of zinc, manganese, aluminum, thorium, lithium, silver, calcium, and any combination thereof.

4. The method as claimed in claim 3, wherein a mass ratio of the magnesium in the magnesium alloys to the other elements is more than 4:1.

5. The method as claimed in claim 1, wherein a diameter of the plurality of magnesium particles is in an approximate range from 20 nanometers to 100 microns.

6. The method as claimed in claim 1, wherein a diameter of the plurality of carbon nanotubes is in an approximate range from 1 nanometer to 150 nanometers.

7. The method as claimed in claim 1, wherein a length of the plurality of carbon nanotubes is in an approximate range from 1 micron to 10 microns.

8. The method as claimed in claim 1, wherein a mass ratio of the plurality of carbon nanotubes to the plurality of magnesium particles is in an approximate range from 1:50 to 1:200.

9. The method as claimed in claim 1, wherein the protective gas is nitrogen or a noble gas.

10. The method as claimed in claim 1, wherein an intensity of the electromagnetic stirring force is adjusted by a power of an electromagnetic stirring device.

11. The method as claimed in claim 1, wherein a speed of the electromagnetic stirring force is adjusted by a frequency of an electromagnetic stirring device.

12. The method as claimed in claim 1, wherein the mixture is heated at a temperature in an approximate range from 550° C. to 750° C.

13. The method as claimed in claim 1, wherein the plurality of carbon nanotubes are saturated in the semi-solid-state paste.

14. The method as claimed in claim 10, wherein the power of the electromagnetic stirring device is in an approximate range from 0.2 kilowatts to 15 kilowatts.

15. The method as claimed in claim 11, wherein the speed of the electromagnetic stirring device is in an approximate range from 500 rpm to 3000 rpm.

* * * * *